United States Patent [19]

Strack, Jr.

[11] 4,393,970

[45] Jul. 19, 1983

[54] HONOR SYSTEM VENDING MACHINE

[75] Inventor: Martin P. Strack, Jr., Conway, Ark.

[73] Assignee: Polyvend Inc., Conway, Ark.

[21] Appl. No.: 288,897

[22] Filed: Jul. 31, 1981

[51] Int. Cl.[3] ..... G07F 11/28

[52] U.S. Cl. ..... 194/17; 292/201

[58] Field of Search ..... 194/51, 59, 65, 1 R, 194/9 T, 10, 9 R; 70/240; 292/201, 216, 207; 194/17

[56] References Cited

U.S. PATENT DOCUMENTS 3,325,203 6/1967 Moler ..... 292/207 X 3,955,840 5/1976 Rawls et al. ..... 292/201 X

*Primary Examiner*—Stanley H. Tollberg

*Attorney, Agent, or Firm*—Stephen D. Carver

[57] ABSTRACT

A coin operated vending machine, and a latching mechanism suitable therefore, both ideally adapted for employment in "honor system" applications. The vending machine preferably comprises a rigid, metallic housing adapted to be disposed upon a supporting surface and an associated door, preferably hingeably coupled to the housing. Unlocking of the door is facilitated by a latching mechanism in response to insertion of coins by the customer. Preferably the latching mechanism comprises a pivoted latch bolt provided with an orifice adapted to be penetrated by an outwardly biased, solenoid controlled locking plunger. A conventional coin mechanism coupled to a self-contained battery supplies a limited duration electric pulse to actuate the solenoid and withdraw the locking plunger. A shield mechanism biased toward the orifice immediately blocks it after the solenoid is energized. When the door is thereafter opened and closed completing a vend, the shield is reset and the latch bolt is deflected to align the orifice for locking penetration by the plunger.

14 Claims, 6 Drawing Figures

HONOR SYSTEM VENDING MACHINE

BACKGROUND OF THE INVENTION

The present invention relates generally to vending machines. More particularly, the present invention relates to a self-powered vending machine adapted for use in "honor system" applications.

In the prior art a wide variety of vending machines have been provided to serially vend solid, prepackaged food products. In response to the insertion of coins of predetermined value, such machines disengage one unit of the selected product from some form of storage rack and route it through suitable passageways or apparatus to a product access area. Typically after a vend the customer manually opens the access door to obtain the vended product. Such machines are of complicated and expensive design, and they typically require installation where an external source of electricity is available. Because of their characteristic cost, such machines must normally be deployed in an area likely to be visited by relatively large numbers of potential customers.

Relatively recently "honor system" food sales have been implemented. Honor system vending arrangements may be ideal where small volumes of sales are contemplated, as with small professional offices or the like. In one typical form of "honor system," individual packages of food are displayed and stored in an unenclosed box, and customers are free to reach into the food storage area and remove food products without paying for them. The "honor system" program depends upon the honesty or integrity of the customer to voluntarily pay for his selected product. Besides the latter disadvantage, prior art "honor system" systems suffer from an obvious vulnerability to outright vandalism, or the like.

I have determined that one of the primary requirements for a successful "honor system" is that access to the product storage area be prevented until insertion of some form of payment. In my system all of the products stored within the housing area are accessible after the system door is opened, but the key factor is that the product access door at least remains locked until some form of payment is made.

However, because the locations in which honor system vending machines may be located often lack any source of electricity, self-contained power supplies (if electricity is needed) are a design requirement. However, if typical prior art locking mechanisms are employed, the normal current drain will quickly wear out normal batteries. As battery failure rates increase, maintenance costs will increase, and the likelihood of vandalism incurred by the inoperative machine at the hands of frustrated customers increases radically. Therefore there is a significant and as yet unfilled demand for self-contained semi-"honor system" vending apparatus equipped with a self-contained, long lasting power supply.

SUMMARY OF THE INVENTION

The present invention comprises a coin operated vending machine of the "honor system" variety.

The machine preferably comprises a rigid, preferably sheet metal housing adapted to be disposed upon some form of supporting surface or structure, and an associated door which is preferably hingeably coupled to the housing. A coin operated system is employed to unlock the door by disengaging a latching means. Once the door is unlocked, it may be moved manually by the customer to an open position thereby exposing prepackaged food products disposed and stored within the housing means.

The lasting mechanism is responsive to a limited duration electric pulse for unlocking the door. The pulse is supplied by a self-contained battery switched by a conventional coin acceptor mechanism. The latching mechanism preferably comprises a latch bolt having a portion thereof adapted to penetrate a suitable notch provided in the door, and an associated solenoid which operates a plunger for locking or unlocking the latch by penetrating an orifice therein. The limited duration electric pulse is applied to the solenoid for disengaging its plunger, which is biased toward the latch bolt. Immediately after disengagement a blocking shield prevents the plunger from reengaging the orifice after cessation of the electric pulse. In this unlocked-but-unopened mode the door is free to be opened by the customer at his leisure.

Moreover, in this mode, the solenoid requires no battery current so that energy is conserved. Upon manual opening of the door the latch bolt deflects the shield out of the way of the solenoid plunger. Upon subsequent closing of the door the latch is deflected until its orifice is aligned with the plunger for subsequent reengagement. As the latch bolt rotates to this latter position, the shield is prevented from interferring by edgewise contact with the solenoid plunger. Thus, after the door has been shut, the outwardly biased solenoid plunger will engage the latch bolt orifice to lock the latching means. The apparatus will remain locked until a subsequent electric pulse is delivered in response to the input of coins.

Because of the unique latch arrangement wherein shield means are provided to temporarily block the plunger orifice, operation is facilitated with a limited duration electric pulse. While pulse type operation has previously been unnecessary in conjunction with vending machines employing commercial AC power, the pulse operated latch described herein facilitates employment of a battery power supply.

Therefore an object of the present invention is to provide an honor system vending machine.

More particularly, it is an object of the present invention to provide an honor system vending machine which requires the payment of certain funds prior to exposing the products to be vended.

Another object of the present invention is to provide a vending machine of the character described adapted to be employed in low volume, low traffic areas which are remote from conventional power sources.

A similar object of the present invention is to provide a self-contained, battery operated vending machine of the character described designed to use as little energy as possible.

Another object of the present invention is to provide a latching mechanism ideally adapted for pulse type actuation whereby to conserve energy and extend battery life.

Yet another object of the present invention is to provide an honor system vending machine of the character described which may be easily serviced and maintained by service personnel.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout to indicate like parts in the various views.

DETAILED DESCRIPTION OF THE INVENTION

Figure 1:
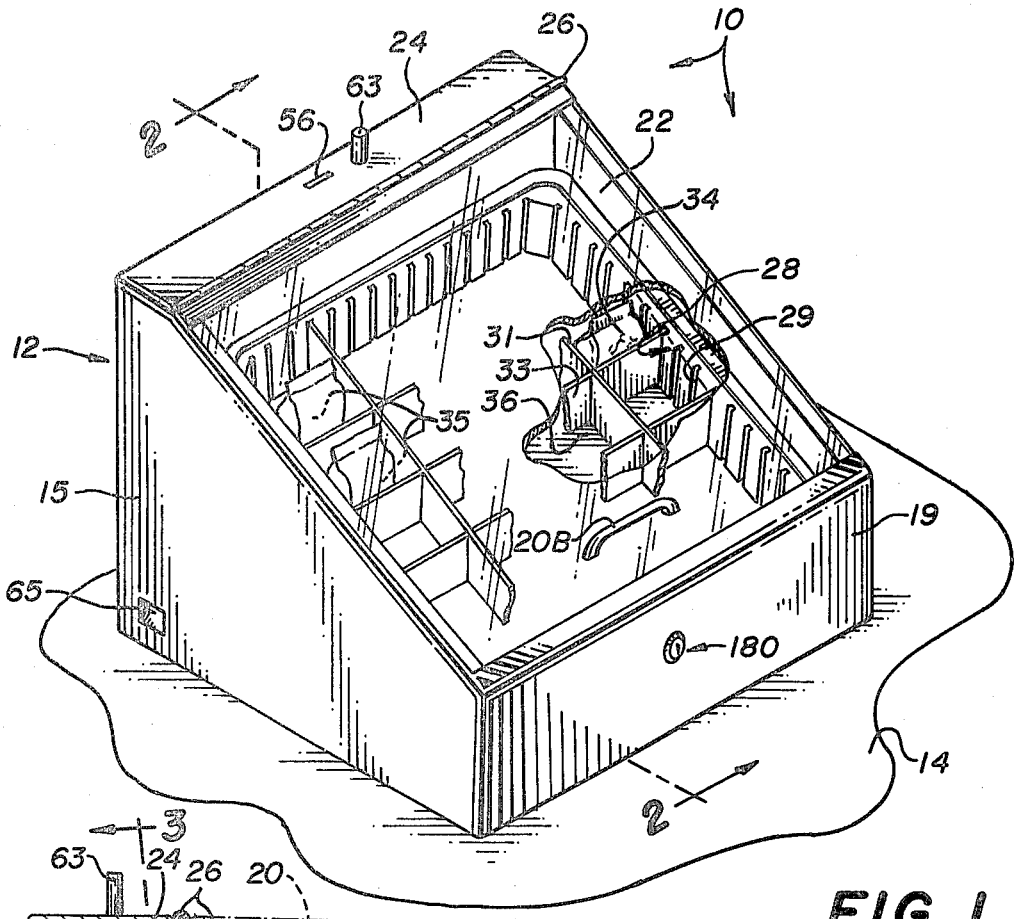
FIG. 1 is an isometric view of an honor system vending machine constructed in accordance with the teachings of this invention, with parts thereof broken away or shown in section for clarity.
Figure 2:
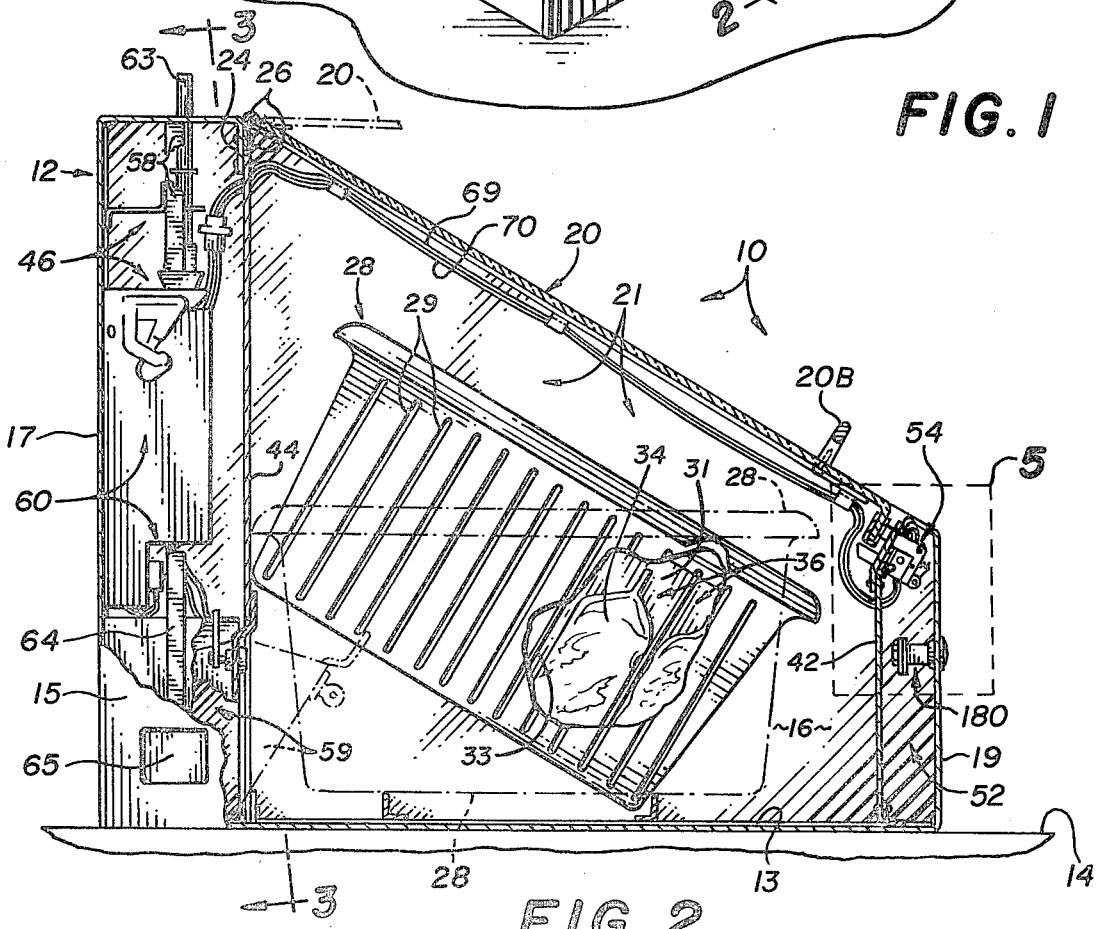
FIG. 2 is an enlarged, sectional view taken generally along line 2—2 of FIG. 1, with parts thereof broken away or omitted for clarity.
Figure 3:
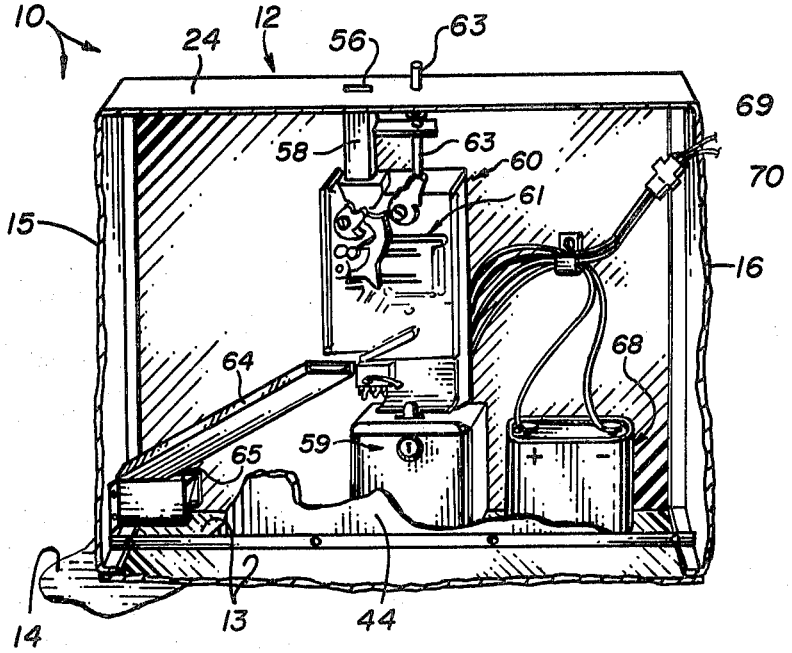
FIG. 3 is a sectional view taken generally along lines 3—3 of FIG. 2, with parts thereof broken away or omitted for clarity.

With initial reference now to FIGS. 1-3 of the drawings, an honor system vending machine constructed in accordance with the teachings of the present invention is generally designated by the reference numeral 10. Vending machine 10 preferably comprises a rigid, metallic, housing 12 adapted to be disposed upon a supporting, generally planar surface 14. Housing 12 comprises a bottom 13 and a pair of end panels 15, 16 terminating at their rear in a back 17 and at their forward end in a front 19 of reduced height. The vending machine door 20 preferably includes a translucent planar sheet 22, and the door 20 is coupled to housing top 24 by an elongated, conventional hinge 26.

As best viewed in FIG. 2, a product storage region 21 is defined within housing 12 between outer sidewalls 15, 16, and internal front and rear partitions 42, 44 respectively. At the rear of the apparatus a separate coin control volume 46 is defined between rear wall 17 and internal rear partition 44. A forward volume 52 defined between partition 52 and wall 19 houses the latching mechanism, generally designated by the reference numeral 54. Floor 13 forms a common bottom for subcompartments 21, 46 and 52.

As best viewed in FIGS. 1 and 2, a preferably removable tray 28 is adapted to be disposed within vending sub-compartment 21 for containing a variety of prepackaged food products. Preferably the basket or tray 28 is provided with a plurality of slots 29 defined in its perimeter to receive typical cardboard dividers 31, 33. Packaged foot items 34, 35, for example, may be placed within the individual compartments 36 defined between the intersecting dividers 31, 33. As best viewed in FIG. 2, the tray 28 may be disposed in a generally inclined orientation or it may be positioned flatly within the apparatus.

Figure 4:
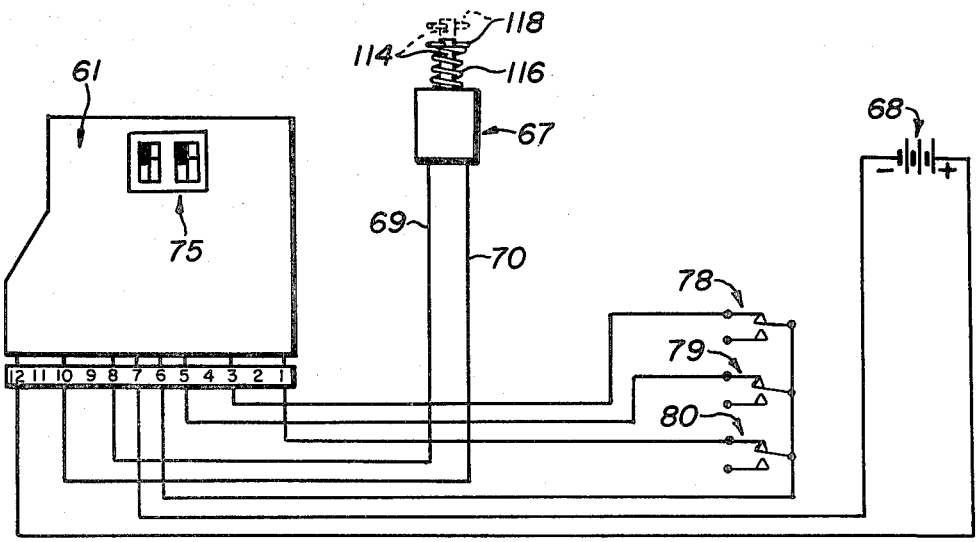
FIG. 4 is an abbreviated electrical control diagram illustrating the electrical circuit preferably employed in conjunction with the present invention.

In operation coins are inserted through rear housing top 24 via coin admission slot 56, and they are passed through coin passage 58 to a coin acceptor unit, generally designated by the reference numeral 60. Coin acceptor mechanism 60 is of conventional construction, including a Model S75-1106 electronic channel assembly manufactured by Coin Acceptors, Inc. The channel assembly is adapted to be preprogrammed by the operator to permit a vend upon insertion of a predetermined amount of coins. Coins incoming via chute 58 will generate a vend and thereafter be stored in storage box 59. However, a coin return 63 is provided to return coins through chute 64 for retrieval via access 65 (FIGS. 1 and 2). The electronic channel assembly is operated by a nominally six-Volt storage battery, generally designated by the reference numeral 68. Battery 68 operates channel assembly 61, which in turn generates a short duration electrical pulse transmitted to solenoid 67 via line 69, 70. Price changing instructions are programmed by manipulating switches, generally designated by the reference numeral 75 (FIG. 4). As coins are inserted into the device, appropriate signals are generated by either the nickel responsive switch 78, the dime responsive switch 79, and/or the quarter responsive switch 80. Thus when coins are deposited, an appropriate signal will be delivered across lines 69, 70 to energize the latching mechanism 54 (i.e. the solenoid 67) to permit opening of the door 20. A handle 20B coupled to the door may be grasped by the user to facilitate product access.

Figure 5:
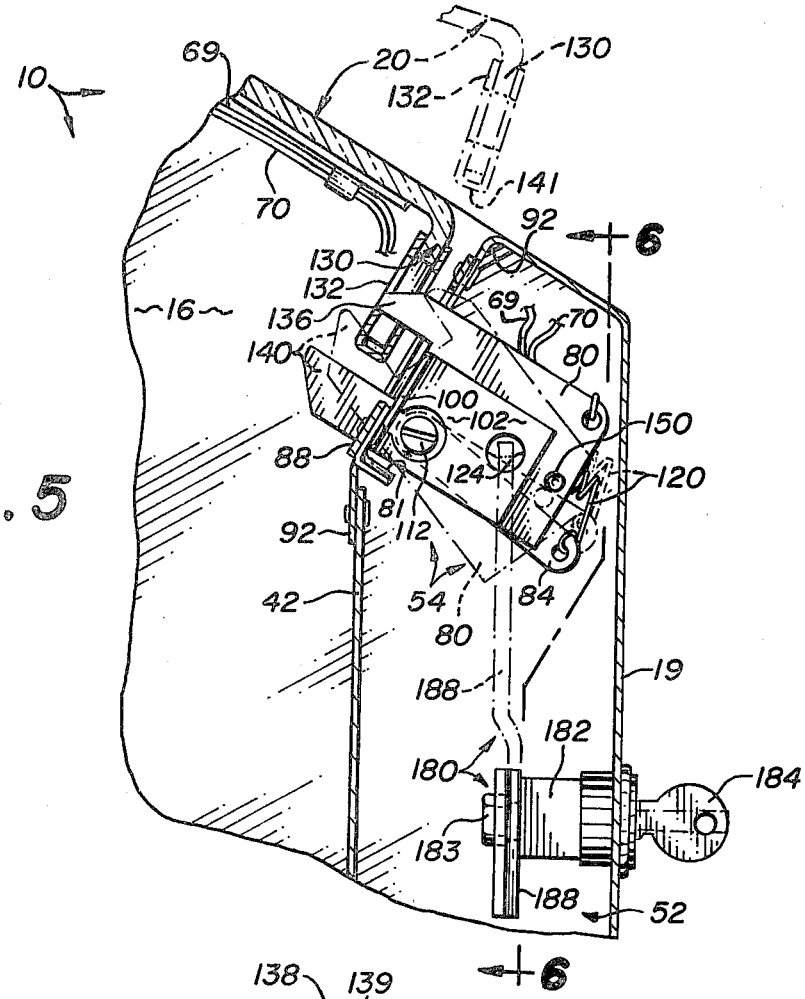
FIG. 5 is an enlarged view of region 5 designated in dashed lines in FIG. 2, with parts thereof shown in moved positions with dashed lines, or omitted or shown in section for clarity; and, FIG. 6 is a sectional view taken generally along line 6—6 of FIG. 5.
Figure 6:
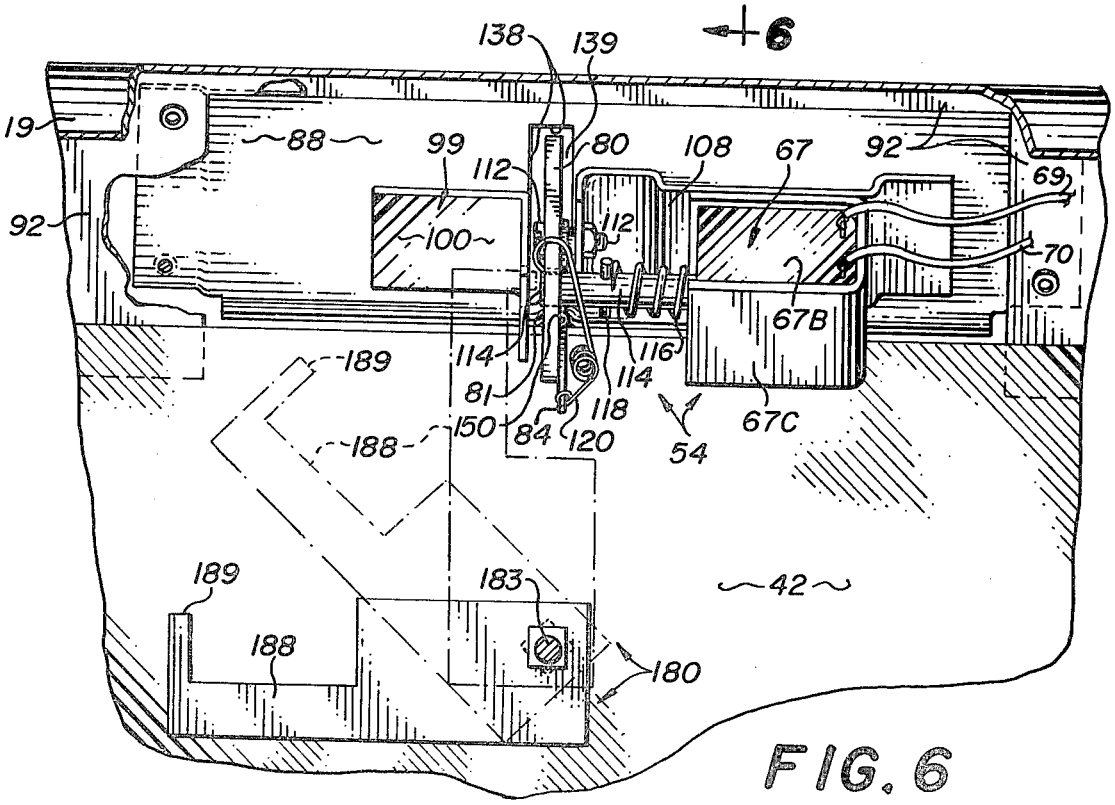

With primary reference now to FIGS. 5 and 6, the latching mechanism 54 preferably comprises a rigid, preferably metallic latch bolt 80, the adjacent, electrical relay 67, and a cooperating shield mechanism 84. In the preferred embodiment the latch mechanism 54 is secured to a latch mechanism mounting plate 88 which is in turn secured to a downwardly, inwardly projecting portion 92 of the housing assembly. An inwardly projecting L-bracket 99 includes a planar portion 100 secured to mounting strut 88, and an integral, outwardly-projecting portion 102 which is spaced-apart from and parallel to latch bolt 80.

Solenoid 67 includes a field 67B secured within conventional shroud 67C. Shroud 67C is secured to relay mounting plate 108, which is fastened to plate 88. A terminal end 109 of relay mounting plate 108 projects perpendicularly outwardly from plate 88, and is oriented in spaced-apart relationship with respect to portion 102 of L-bracket 100. Latch bolt 80 and adjacent shield 84 are pivotally mounted between members 102, 109. A nut and bolt combination generally designated by the reference numeral 112 penetrates latch bolt 80, shield 84 and member 109. Both shield 84 and latch bolt 80 may thus pivot to positions indicated in dashed lines in FIG. 5.

A Doormyer model B21 is ideal for solenoid 67. Solenoid 67 operates a magnetic, cylindrical plunger 114 which is biased outwardly from relay 67 toward engagement and contact with latch bolt 80 by a spring 116 retained by a pin 118. A spring 120 is employed to yieldably bias shield 84 towards the position illustrated in dashed lines in FIG. 5. In this position shield 84 will block orifice 124, which may otherwise be penetrated by plunger 114 to lock the latch bolt mechanism.

Door structure 20 terminates at its forward end in a downwardly projecting lip, generally designated by the reference numeral 130. Lip 130 may be reinforced by a channel 132 secured about it. Of course a variety of other door configurations may be used. It will be noted that latch bolt 80 terminates in an upper portion 136 adapted to engage a suitable door notch 138 by extending through a surrounding, adjacent passageway 139 defined in mounting plate 88. Latch bolt 80 also includes a lower lip 140 which, as will be explained in detail later, is adapted to be contacted by the bottom edge 141 of the door lip when the door is closed.

In operation the latching mechanism 54 assumes one of four states. The first state of operation corresponds to the vending machine being shut, and door 20 being locked. This is the rest or static state illustrated in solid lines in FIGS. 5 and 6. The second state occurs immediately after insertion of a designated amount of coins, whereupon coin mechanism 60 (more particularly channel mechanism 61) generates a short duration electric pulse to actuate solenoid 67, whereby to withdraw plunger 114 from latch bolt orifice 124. When this second state occurs, it should be appreciated that shield 84 will be moved upwardly (to the position illustrated in dashed lines in FIG. 5) by spring 120. In this situation locking orifice 124 will be substantially blocked from repenetration by plunger 114. Plunger 114 will contact shield 84 in response to yieldable tension supplied by its spring 116. A vend is now possible by merely opening door 12.

A third state of operation occurs when door 12 is being opened, as illustrated in dashed lines in FIG. 5. In this situation latch bolt 80 will be deflected to the position illustrated in dashed lines in FIG. 5. When door 12 is opened, upward pressure upon latch bolt portion 136 will pivot the latch bolt about pivot point 112, and concurrently latch bolt boss 150 will contact shield 84 to force it out of engagement with plunger 114. In this position plunger 114 will slidingly contact the surface of latch bolt 80, but it will not be aligned with orifice 124 so it will not penetrate same. Latch bolt 80 will pivot rearwardly until stopped by contact with stop 81.

In the fourth state of operation door lip 130 will be dropping into housing volume 21 until it contacts latch bolt lip 140. At this time, the latch bolt will be returned to the static position, and plunger 114 will ride upon the exposed inner surface of latch bolt 80 simultaneously contacting the upper edge of shield 84 to move it out of the way. Movement will continue until orifice 124 is aligned with plunger 114, whereupon the locked state (the first state of operation discussed above) is resumed.

To allow efficient service of the apparatus 10 without depositing coins, an optional key operated system, generally designated by the reference numeral 180, is provided. System 180 includes a key mechanism 182 secured to front panel 19, which is operated by a conventional key 184. Key 184 rotates an internal cam latch 188 which includes a forwardly projecting, contact element 189 adapted to be pivoted about point 183 into contact with plunger 114 by penetrating latch bolt orifice 124. Once cam latch portion 189 moves plunger 114 to the right (as viewed in FIG. 6) shield 84 will engage. It is to be noted that the diameter of cam latch portion 189 is substantially smaller than that of the plunger 114. Thus the latching mechanism 54 may be manually disengaged simply by operating key mechanism 180.

Thus the latching mechanism 54 facilitates the use of battery power. The limited pulse supplied by the battery is sufficient to initiate the shield. Thereafter mechanical energy inputted by the moving door resets and relocks the mechanism.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A coin operated vending machine comprising:

housing means adapted to be disposed upon a supporting surface or structure for containing products to be vended;

door means associated with said housing means and adapted to be moved between an open, product accessible position and a closed position;

latching means for releasably maintaining said door means in a closed position, the latching means comprising:

latch bolt means for engaging said door means;

solenoid means for locking said latch bolt means, said solenoid means including plunger means for engaging said latch bolt means, said solenoid means adapted to disengage said plunger means from said latch bolt means thereby unlocking said latch bolt means in response to solenoid energization; and, shield means for temporarily preventing said plunger means from lockably engaging said latch bolt means after deenergization of said solenoid means to permit subsequent opening of said door means;

coin acceptor means for switching current to said solenoid means in response to the input of preselected coins, whereby to permit opening of said door means to facilitate a vend; and, power supply means for supplying current to said coin acceptor means.

2. The combination as defined in claim 1 wherein said power supply means comprises a battery disposed within said housing means.

3. The combination as defined in claim 2 wherein:

said latch bolt means is pivotally mounted within said enclosure for movement between door engaging and door disengaging positions; and, said door means includes a locking notch adapted to be penetrated by said latch bolt means when said door is in a closed position.

4. The combination as defined in claim 1 wherein:

said latch bolt means includes an orifice adapted to be penetrated by said plunger means;

said shield means is pivotally secured for movement relative to said orifice; and, said latching means includes means for yieldably urging said shield means toward an orifice blocking position whereby to immediately temporarily block said orifice upon withdrawal of said plunger means therefrom.

5. The combination as defined in claim 4 wherein said shield means is deflected from an orifice blocking position in response to closing of said door means whereby to permit relocking of said door means by facilitating repenetration of said orifice by said plunger means.

6. The combination as defined in claim 5 wherein said latch bolt means includes boss means for forcibly disengaging said shield means in response to opening of said door means.

7. The combination as defined in claim 6 wherein said latch bolt means includes a lip portion adapted to be contacted by said door means during closing of said door means whereby to return said latch bolt means to a position wherein said orifice is aligned for penetration by said plunger means.

8. The combination as defined in claim 6 including key operated means for mechanically depressing said plunger means whereby to unlock said door means independently of said coin acceptor means.

9. The combination as defined in claim 8 wherein said power supply means comprises a battery disposed with said housing means.

10. A mechanically resettable latching mechanism responsive to an electric pulse for subsequently releasing a structural member such as a door or the like, said latching mechanism operable to normally maintain said structural member in a locked position, said latching mechanism comprising:

latch bolt means for engaging said structural member;

said latch bolt means pivotally mounted for movement between member locking and member unlocking positions;

said structural member including a locking notch adapted to be penetrated by said latch bolt means when said member assumes a locked position;

solenoid means for locking said latch bolt means, said solenoid means including plunger means for engaging said latch bolt means, said solenoid means adaped to disengage said plunger means from said latch bolt means thereby unlocking said latch bolt means in response to an electric pulse;

said latch bolt means including an orifice adapted to be penetrated by said plunger means;

shield means for temporarily preventing said plunger means from lockably engaging said latch bolt means after deenergization of said solenoid means to permit subsequent release of said structural member, said shield means pivotally secured for movement relative to said latch bolt means orifice; and, said latching mechanism including means for yieldably urging said shield means toward an orifice blocking position whereby to immediately temporarily block said orifice upon withdrawal of said plunger means from said orifice.

11. The combination as defined in claim 10 wherein said shield means is deflected from an orifice blocking position in response to movement of said structural member whereby to permit relocking of said structural member by facilitating repenetration of said orifice by said plunger means.

12. The combination as defined in claim 11 wherein said latch bolt means includes boss means for forcibly disengaging said shield means in response to initial movement of said structural member.

13. The combination as defined in claim 12 wherein said latch bolt means includes a lip portion adapted to be contacted by said structural member during return movement thereof whereby to return said latch bolt means to a position wherein said orifice is aligned for penetration by said plunger means.

14. The combination as defined in claim 12 including key operated means for mechanically depressing said plunger means whereby to release said structural member independently of said solenoid means.

* * * * *